US005109247A

United States Patent [19]

Furuya et al.

[11] Patent Number: 5,109,247

[45] Date of Patent: Apr. 28, 1992

[54] FILM PROCESSING APPARATUS

[75] Inventors: Kunio Furuya; Kazuhiro Nemoto; Kazuhiko Watanabe; Toshiyuki Mohri, all of Tokyo, Japan

[73] Assignee: Konica Corporation, Tokyo, Japan

[21] Appl. No.: 516,098

[22] Filed: Apr. 27, 1990

[30] Foreign Application Priority Data

May 2, 1989 [JP] Japan ..... 1-112062

[51] Int. Cl.[5] ..... G03D 3/12

[52] U.S. Cl. ..... 354/319; 354/310; 354/320

[58] Field of Search ..... 354/310, 311, 312, 313, 354/314, 316, 319, 320, 321, 322; 378/182

[56] References Cited

U.S. PATENT DOCUMENTS 3,276,769 10/1966 Kallenberg ..... 354/320
4,482,233 11/1984 Baue et al. ..... 354/312
4,760,417 7/1988 Zwettler et al. ..... 354/321

*Primary Examiner*—Alan A. Mathews
*Attorney, Agent, or Firm*—Jordan B. Bierman

[57] ABSTRACT

The invention provides an apparatus for processing a photographed film which is stored in a cassette. In a housing of the apparatus, a film taking-out device, a developing device, and a film conveying device are incorporated, wherein on one side of the housing there is provided a slot for inserting the cassette to the film taking-out device, and the film taking-out device and the developing device are arranged side by side so that on the same side of the housing there is provided an outlet for delivering the film from the developing means.

8 Claims, 4 Drawing Sheets

FILM PROCESSING APPARATUS

BACKGROUND OF THE INVENTION

This invention relates to a film processing apparatus in which an exposed X-ray film in a cassette is developed by an automatic developing device.

Conventionally, an X-ray film exposed in a hospital is put into a flat case called a cassette, conveyed, and set into a film processing apparatus to be developed. In the film processing apparatus, the exposed film is taken out from the cassette by a film-taking-out-unit and developed by an automatic developing unit.

The automatic developing unit is provided with a developing tank, a fixing tank, a washing tank, and a drying tank. The exposed film taken out from the cassette is conveyed by conveyance rollers, processed in the developing tank, the fixing tank, and the washing tank, and finally dried in the drying tank. After processed in the automatic developing unit, the film is taken out from the unit as a negative film. As for this type of apparatus, the apparatus has been widely known which is characterized in that: the film-taking-out-unit and the automatic developing unit are arranged in the film conveying direction; and when the cassette is inserted into the apparatus from the front side of the apparatus, the developed film is delivered from the rear side of the apparatus. However above-described type of apparatus has this disadvantage, that the operative efficiency is low because the operator of the apparatus must come and go between the front side and the rear side of the apparatus.

The vertical type apparatus has been known in which the film-taking-out-unit is set above the automatic developing unit. This type of apparatus has a high operative efficiency because the apparatus can be operated from one side. However, it is difficult to maintain the automatic developing unit in the case of this type of apparatus.

To be more concrete, the problems are as follows. The developing solution and the fixing solution adhere to the conveyance rollers and the support members of the automatic developing unit which are located between the developing tank and the fixing tank, and between the fixing tank and the washing tank, and the adhered chemicals are crystallized after a while. There is the possibility that the crystallized chemicals scratch the film surface or block the film conveyance in the apparatus. Accordingly, it is common in this type of apparatus; to provide the conveyance rollers assembled in a rack structure to the developing, fixing, washing, and drying tanks, wherein the conveyance rollers can be rapidly attached to and removed from the apparatus; to remove the rollers from the apparatus after film processing in a day has been completed; and to clean the rollers with a brush in order to remove the solution and the crystallized chemicals adhered to the roller surface and support members. However, when the vertical type apparatus is adopted, the automatic developing unit needs to be pulled out towards the operator's side in order to clean the rollers, wherein the developing solution, fixing solution, and water are contained in the tanks of the automatic developing unit. There is a problem that the solution spills out the tank when the automatic developing unit is pulled out, and furthermore the automatic developing unit needs to be held horizontally when the unit is returned to the original position in the apparatus. Pulling out the developing unit for cleaning has a serious problem to operators. In order to operate the automatic developing unit properly, it is very important to hold it horizontally. Conventionally, some careful measures have been taken to solve this problem, for example, screws to adjust the height of the apparatus are provided to the legs of the apparatus so that the apparatus can be held horizontally. It is preferable that the automatic developing unit is not moved as a general rule.

SUMMARY OF THE INVENTION

The object of the present invention is to provide a novel film processing apparatus in which an automatic developing unit can be easily maintained without the decrease in maneuverability, wherein the film processing apparatus is characterized in that: a film-taking-out-means which takes out a exposed film from a cassette inserted to the apparatus through a cassette inserting slot, and an automatic developing means which develops the exposed film and delivers it from a film delivery outlet, are arranged sideways so that the cassette inserting slot and the film delivery outlet can be located on the front side of the apparatus; and a film conveyance means which conveys the exposed film taken out from the cassette by the film-taking-out-means to the automatic developing means, is located at the rear of the apparatus.

DETAILED DESCRIPTION OF THE INVENTION

Figure 1:
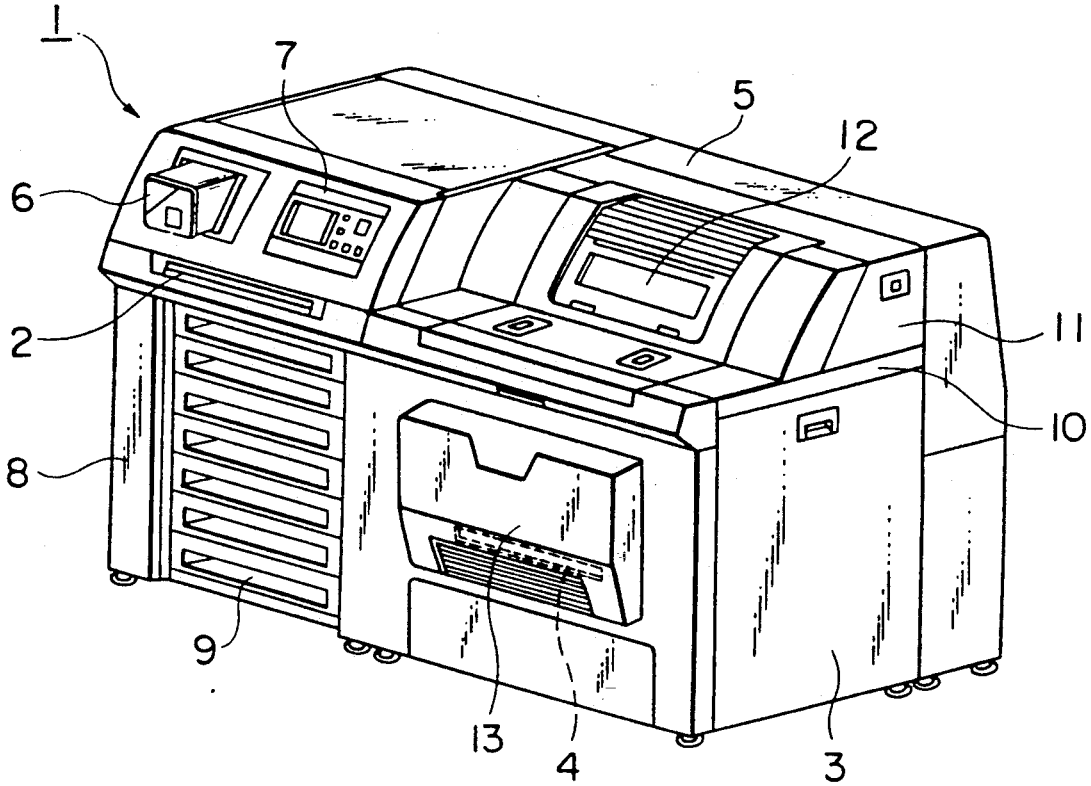
FIG. 1 is a perspective view of an example of the film processing apparatus of the present invention.

Referring to the drawings, the film processing apparatus of the present invention will be explained.

FIG. 1 shows the appearance of the film processing apparatus of the present invention.

In FIG. 1, the numeral 1 is a film-taking-out-unit in which an exposed film is taken out from a cassette which is inserted from the cassette inserting slot 2 to the unit. The numeral 3 is an automatic developing unit in which the exposed film is developed, after developed the film is delivered from the film delivery outlet 4. The numeral 5 is a film conveyance unit by which the exposed film taken out from the cassette in the film-taking-out-unit 1 is conveyed to the automatic developing unit 3. As illustrated in FIG. 1, the film-taking-out-unit 1 and the automatic developing unit 3 are arranged sideways. The cassette inserting slot 2 and the film delivery outlet 4 are placed on the front surface of the apparatus and the film conveyance unit 5 is placed at the rear of the apparatus. The numeral 6 is a name card receiver into which the name card of a subject is put so that the subject's name can be photographed on films. The numeral 7 is an operation panel. The operation panel 7 is provided with a power source switch, a knob to set the developing density, a film size selecting button which is used to select the size of an unexposed film to be supplied to the cassette, indicating lamps to display the progress of processing and warning, a counter to indicate the number of used films, and the like. A film supply unit is provided below the film-taking-out-unit 1, wherein the film supply unit supplies an unexposed film to the cassette. The film supply magazine inserting slot 9 at the film supply unit through which film supply magazines (not illustrated in the drawing) are loaded according to the film size (7 sizes are illustrated in the drawing), is provided below the film-taking-out-unit 1.

The upper board 10 equipped with a sliding means (not illustrated in the drawing) comprising rails and rollers, can be pulled out towards the operator's side with the autofeeder unit 11 on it.

The film basket 13 is provided to the film delivery outlet 4 so that the developed film can be received. The films stocked in the basket 13 can be taken out from an upper opening.

Figure 2:
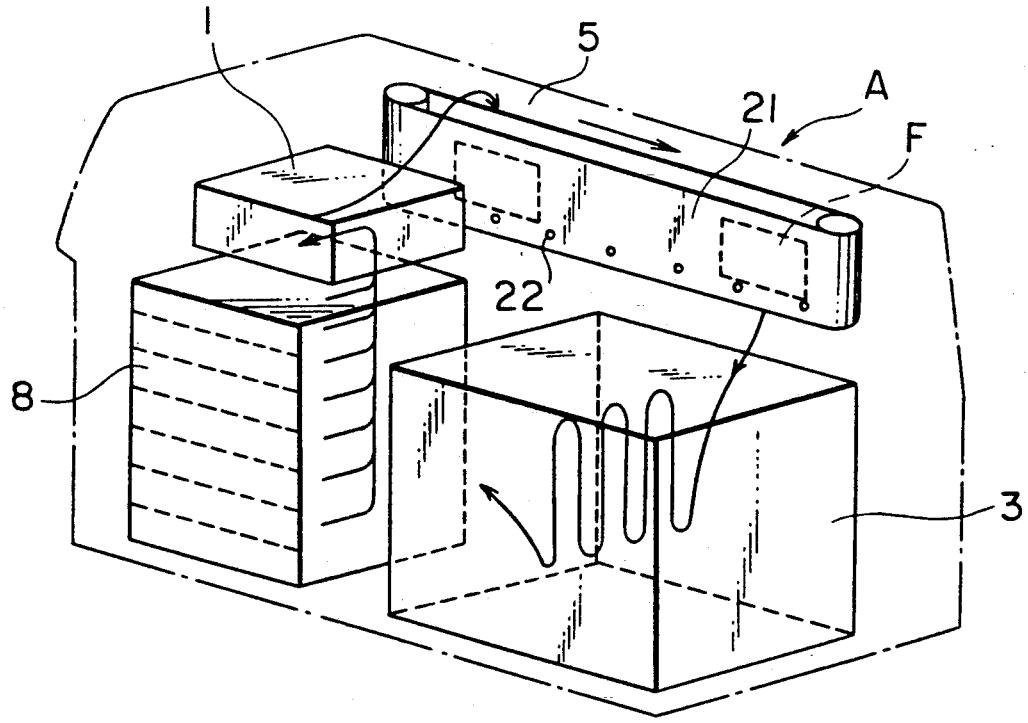
FIG. 2 is a schematic illustration which shows the film passage in the film processing apparatus illustrated in FIG. 1.

FIG. 2 is a drawing which illustrates a film passage in the apparatus. In the film-taking-out-unit 1, an exposed film is taken out by the film-taking-out-means. Then, the cassette is loaded with an unexposed film sent from the film supply unit 8. The exposed film F taken out from the cassette is conveyed to the automatic developing unit 3 by the film conveyance unit 5.

The film conveyance unit 5 is equipped with the endless belt 21. The endless belt 21 is stretched between two rollers, wherein one edge of the belt is placed upward and the other edge of the belt is placed downward as illustrated in FIG. 2 and the belt is inclined. The film hold pins 22 which hold X-ray film F, are provided to the lower edge of the endless belt 21. Film F is conveyed by the pins 22 and on the surface of the endless belt 21 located on the rear side of the apparatus. Film F conveyed is developed in the automatic developing unit 3 and delivered onto the film delivery outlet 4.

Figure 3:
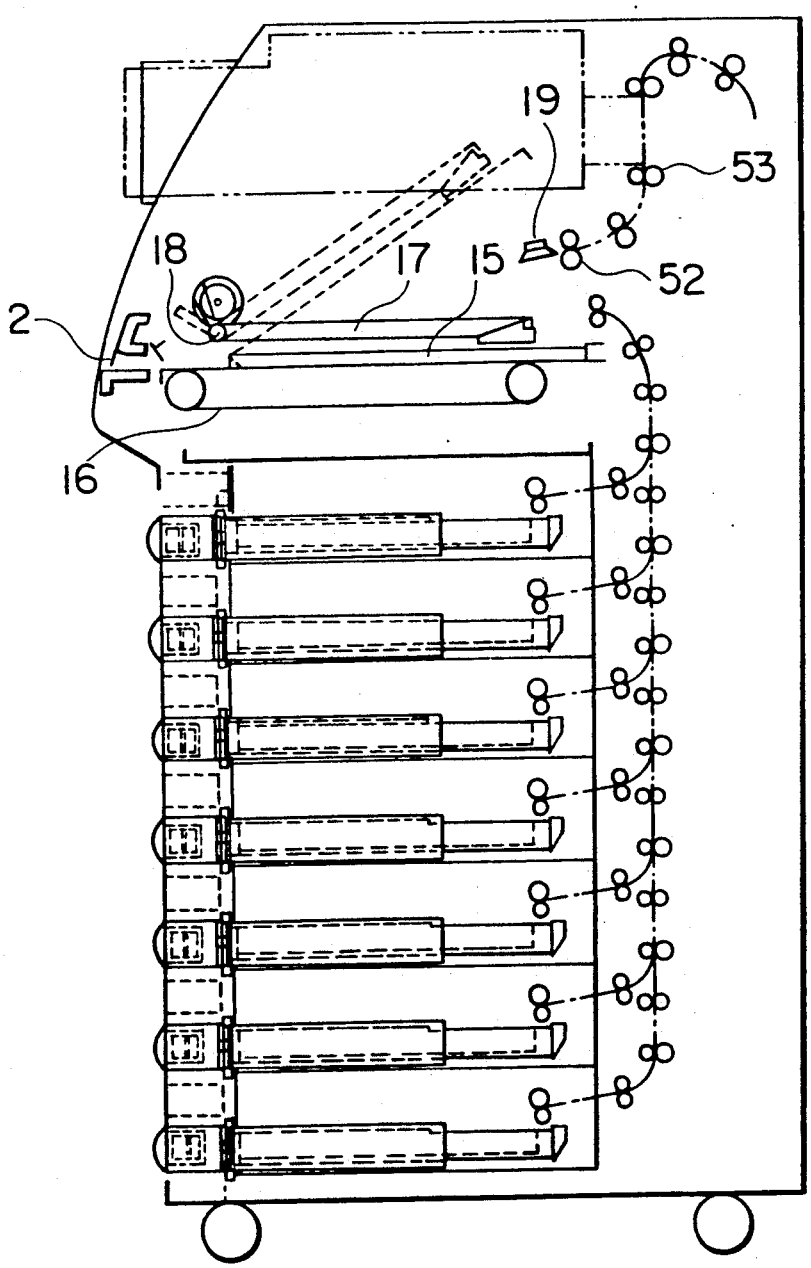
FIG. 3 is a sectional view of the film-taking-out-means.

FIG. 3 is a drawing which illustrates the film-taking-out-means. The numeral 2 is a cassette inserting slot into which the cassette 15 is inserted. The numeral 16 is an endless belt which conveys the inserted cassette to the film replacing position. The numeral 17 is an arm which opens and closes the lid of the cassette 15. The arm 17 goes up and down, wherein the shaft 18 is used as a fulcrum. In the beginning, the arm 17 is located above the cassette 15, and it goes down when the cassette 15 is conveyed to the film replacing position. Since a permanent magnet is provided to the tip of the arm 17, the lid of the cassette 15 is attracted by the magnet. Then, the arm 17 goes up and the lid of the cassette 15 is opened. After the film is replaced, the lid of the cassette 15 is closed by the arm 17 and the arm 17 goes up again leaving the lid of the cassette 15 closed. Then, the belt 16 is driven in the reverse direction and the cassette 15 is returned to the cassette inserting slot 2.

The numeral 19 is a sucker which sucks the film in the cassette 15 and inserts it between the rollers 52. A group of rollers 53 conveys a film and drops it onto the pin 22 provided on the endless belt 21 as shown in FIG. 1.

Figure 4:
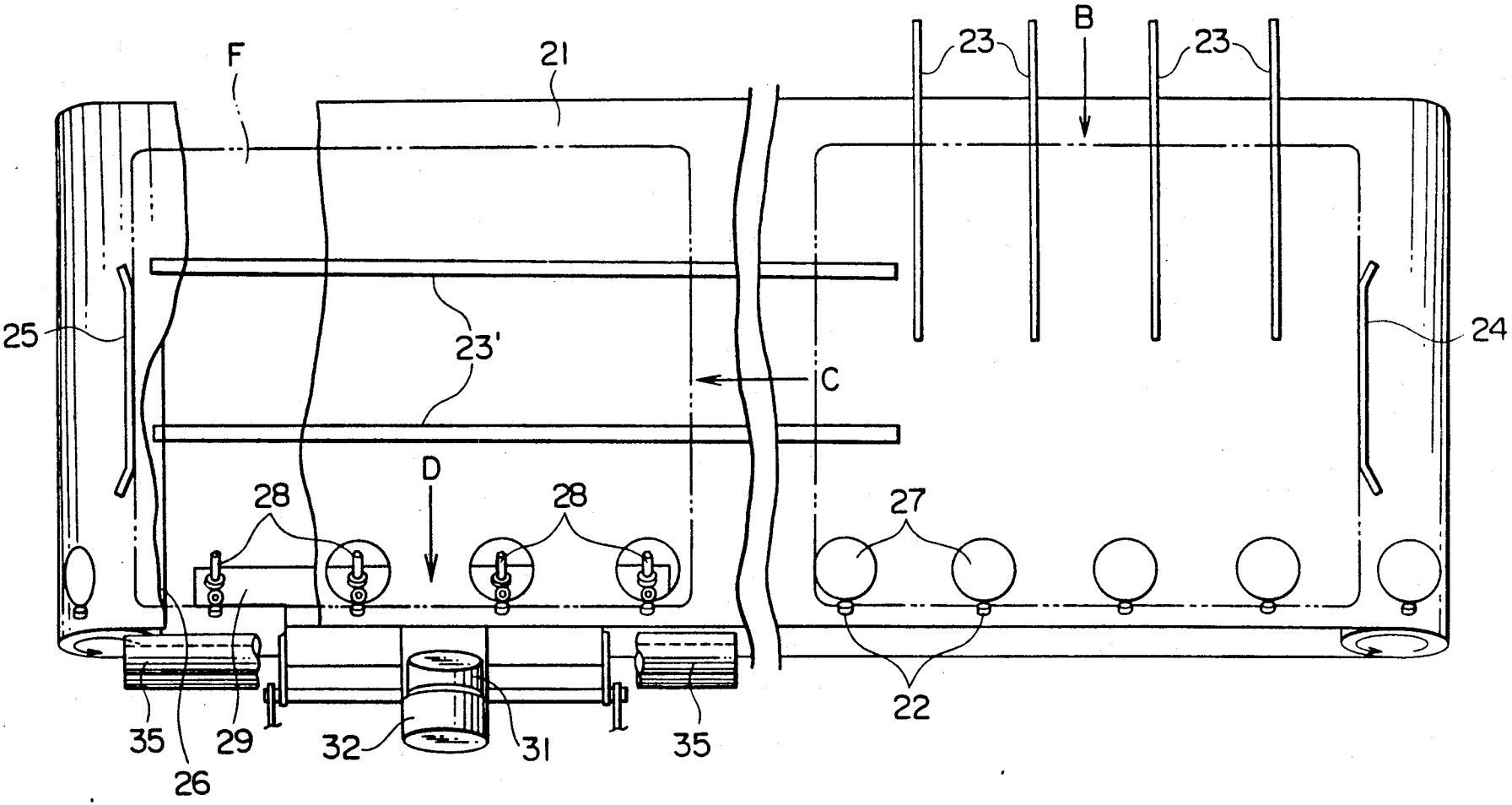
FIG. 4 is a front view of an example of the film conveyance means.
Figure 5:
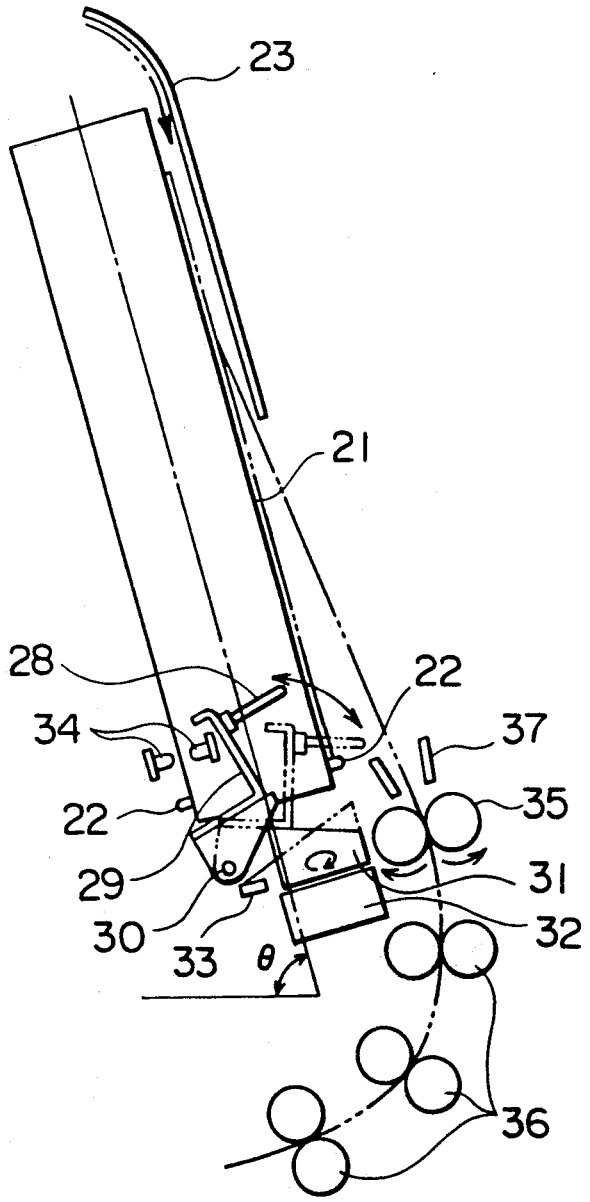
FIG. 5 is a sectional view of the film conveyance means illustrated in FIG. 4.

FIG. 4 is a rear elevation which illustrates the rear of the film conveyance unit 5. (Refer to the arrow mark A in FIG. 2.) FIG. 5 is a vertical section of FIG. 4.

The film guide 23 comprising a plurality of rod members is provided in the upstream (the right side of FIG. 4) portion of the endless belt 21. The film guide 23' is provided in the downstream portion of the endless belt 21 in parallel with the film conveyance direction, and furthermore the right side guide 24 and the left side guide 25 are provided at both sides of the endless belt 21.

A plurality of film hold pins 22 are provided to the lower edge of the endless belt 21 at regular intervals. Although the material used for the pins 22 is not restricted, it is preferable to use the material which does not damage the edge of Film F. When a metal is used as the material of the pins 22, the pins 22 are mounted on the endless belt 21 by reveting. When a resin is used, the pins are adhered to the endless belt 21 surface.

The holes 27 are provided above the pins 27 on the endless belt 21. The endless belt 21 is driven by the drive roller 26 and is moved from the right to the left in FIG. 4.

Referring to FIG. 4, inside the endless belt 21 in the downstream portion (the left side in FIG. 4) of the belt movement, a plurality of film pushing claws 28 are mounted on the claw mounts 29 which are rotatably provided to the shaft 30. When the claw mount 29 rotates clockwise around the shaft 30, the film pushing claw 28 protrudes from the endless belt through the hole 27 and when the claw mount 29 rotates counterclockwise around the shaft 30, the film pushing claw 28 withdraws inside the endless belt 21. The claw mount 29 is pushed clockwise by a spring not illustrated in the drawing and its bottom surface comes into contact with the cam 31. As shown in FIG. 5, the shape of the cam 31 is like a slashed cylinder and the cam 31 is rotated by the motor 32. The height of the position in which the cam 31 comes into contact with the bottom surface of the claw mount 29, varies as the cam 31 is rotated. Accordingly, the claw mount 29 is rotated around the shaft 30. As a result, the film pushing claw 28 is protruded from the hole 27 of the endless belt 21 and is withdrawn through the hole 27. The rotary position of the cam 31 is detected by the sensor 33.

The numeral 34 in FIG. 5 is a photosensor, wherein the endless belt 21 is located between the emitting element and the receiving element of the photosensor 34 and the hole 27 in the endless belt 21 passes between the emitting element and the receiving element of the photosensor as the belt moves. As the photosensor 34 detects the number of the holes 27 which have passed through the photosensor 34, the belt travel distance can be detected. The first conveyance rollers 35 are provided under the belt 21 at the downstream of the belt movement and the guide 37 is provided above the conveyance rollers 35 so that film F which has been pushed down by the film pushing claw 28 can be guided and conveyed. The first conveyance rollers 35 are followed by a group of rollers 36.

Referring to FIG. 5, the endless belt 21 is inclined forming an angle of $\theta$ with the horizontal direction. The larger the inclined angle $\theta$ is, the shorter the depth of the apparatus is. However, when the inclined angle $\theta$ is too large, a severely curled film sometimes slips down from the endless belt 21, which causes a problem in film conveyance. According to the experiment made by the inventors, the inclined angle of $65° \leqq \theta \leqq 85°$ is most effective when the consideration is given to the film curling and furthermore to the belt conveyance speed. When the inclined angle of the endless belt is set to this angle, the film is surely conveyed by the endless belt 21 and the depth of the apparatus can also be reduced.

The motion of the belt conveyance will be explained as follow.

Exposed film F conveyed from the film-taking-out-unit 1 by the rollers 53 illustrated in FIG. 3, is conducted by the guide 23 in the direction of an arrow mark B shown in FIG. 4. Then the film F is dropped between the endless belt 21 and the guide 23. When film F is dropped, the lower edge of film F is caught and held by the pin 22. As a result, film F is set on the endless belt 21. When film F is dropped slantingly, its position is corrected by the right side guide 24 so that the film can be dropped properly. The endless belt 21 is driven by the drive roller 26 and film F is conveyed between the guide 23' and the endless belt 21 being guided by the guide 23' in the direction of an arrow mark C in FIG. 4. When film F is conveyed to the downstream position of the belt movement and the photosensor 34 detects the predetermined belt travel, the belt 21 is stopped. The belt 21 is stopped so that the hole 27 in the belt 21 can come just in front of the film pushing claw 28.

After the belt 21 is stopped, the motor 32 is started and the film pushing claw 28 is inclined to push out film F so that film F is dropped onto the first rollers 35. Then, film F is conveyed to the automatic developing unit 3 by the first rollers 35 and the rollers 36 so as to be developed.

A sensor not illustrated in the drawing is provided at the downstream position of the belt movement, wherein the sensor detects that film F has been dropped from the endless belt 21. When the sensor detects the drop of film F, the endless belt 21 is started again to convey the following film.

In the above-described example, film F is conveyed by the endless belt 21 and the pins 22 mounted on the belt. However, it is to be understood that the present invention is not intended to be limited to the specific examples. For instance, another conveyance method can be adopted to realize the present invention, wherein the conveyance method can be; conveying film F in such a manner that the film edge is held by a clip; and conveying film F in such a manner that the film is put in a thin conveying box to be conveyed in an inclined position. When the above-described conveying method is adopted, the angle $\theta$ can be approximately 90°. Accordingly, the size of the space where the apparatus is installed can be further reduced.

As explained above, in the present invention, the film-taking-out-means and the automatic developing means are arranged sideways and the cassette inserting slit and the film delivery outlet are arranged on the front side of the apparatus, which is effective in simplifying the maintenance of the apparatus without decreasing maneuverability. As an X-ray film is conveyed in an inclined position when it is conveyed to the automatic developing means after being taken out from a cassette, the depth of the apparatus can be made shorter than that of the apparatus in which the X-ray film is conveyed in a horizontal position. Accordingly, the size of the space where the apparatus is installed, can be reduced and it is useful for a hospital in order to be able to utilize the space effectively.

What is claimed is:

1. An apparatus for processing a photographic sheet film stored in a cassette, said film having at least four edges including a first edge, a second edge opposite to said first edge, a third edge substantially perpendicular to said first edge and a fourth edge opposite to said third edge, said apparatus comprising;

a housing for housing a film removal unit, developing unit, and conveyer, said housing including an operation side wall having an inlet slot through which said cassette is inserted and a second side wall opposite to said operation side wall;

said film removal unit receiving said cassette through said slot, removing said film from said cassette and moving said film in a first direction in which said first edge is the leading edge from said operation side wall toward said second side wall;

said conveyer receiving said film from said film removal unit, and conveying said film to said developing unit in a second direction substantially perpendicular to said first direction, whereby said third edge becomes the leading edge;

said developing unit receiving said film from said conveyer, and developing said film while moving said film in a third direction opposite to said first direction, whereby said first or second edge becomes the leading edge, to an outlet slot for delivering said developed film formed on said operation side wall.

2. The apparatus of claim 1, wherein said conveyer comprises a conveying belt.

3. The apparatus of claim 2, wherein said conveying belt is arranged to be slanted so as to have low side edge and high side edge.

4. The apparatus of claim 3, wherein said low side edge of said conveying belt is provided with means for holding said film.

5. The apparatus of claim 3, wherein said conveying belt is slanted with angle $\theta$, in which angles $\theta$ satisfies the following relation;

$$65° \leqq \theta \leqq 85°.$$

6. The apparatus of claim 4, further comprising a dropping unit for dropping said film from said conveying belt to said developing unit.

7. The apparatus of claim 6, wherein said conveying belt has a hole near said holding means, and wherein said dropping unit has a pushing member for pushing said film through said hole to drop said film from said conveying belt.

8. The apparatus of claim 1, further comprising a reversing unit for reversing said sheet film so that in moving from said developing unit to said outlet slot, said first edge becomes said leading edge.

* * * * *